United States Patent [19]

Nagy et al.

[11] Patent Number: 4,559,278

[45] Date of Patent: Dec. 17, 1985

[54] ELECTROLYTICALLY RHENIUM COATED MOLYBDENUM CURRENT INLET CONDUCTOR ASSEMBLY FOR VACUUM LAMPS

[75] Inventors: János Nagy; László Nagy; Endre Oldal, all of Budapest, Hungary

[73] Assignee: Tungsram Reszvenytarsasag Abr. Tungsram Rt., Budapest, Hungary

[21] Appl. No.: 541,337

[22] PCT Filed: Jan. 27, 1983

[86] PCT No.: PCT/HU83/00002

§ 371 Date: Sep. 19, 1983

§ 102(e) Date: Sep. 19, 1983

[87] PCT Pub. No.: WO83/02684

PCT Pub. Date: Aug. 4, 1983

[30] Foreign Application Priority Data

Jan. 28, 1982 [HU] Hungary ..... 254

[51] Int. Cl.[4] ..... H01J 17/16; C23C 5/00; C25D 5/00

[52] U.S. Cl. ..... 428/630; 428/620; 428/661; 428/663

[58] Field of Search ..... 428/630, 663, 614, 620, 428/661

[56] References Cited

U.S. PATENT DOCUMENTS

| | | | |
|---|---|---|---|
| 2,113,984 | 4/1936 | Harris et al. | 428/630 |
| 2,859,562 | 11/1958 | Dorgelo et al. | 428/630 |
| 3,386,159 | 6/1968 | Milch et al. | 428/663 |
| 3,504,426 | 4/1970 | Craig et al. | 428/663 |
| 4,277,716 | 7/1981 | Banks | 428/630 |

FOREIGN PATENT DOCUMENTS

| | | | |
|---|---|---|---|
| 1352319 | 5/1974 | United Kingdom | 428/663 |
| 257629 | 12/1970 | U.S.S.R. . | |
| 702427 | 12/1979 | U.S.S.R. . | |

OTHER PUBLICATIONS

Handbook of Galvanic Coating in Mechanical Engineering–Moscow, 1979–translation of pp. 88 to 90.

*Primary Examiner*—Veronica O'Keefe
*Attorney, Agent, or Firm*—Karl F. Ross; Herbert Dubno

[57] ABSTRACT

The invention relates to a current inlet conductor assembly particularly for vacuum devices, especially for light sources such as incandescent lamps or discharge tubes, comprising an inlet conductor made of molybdenum for passing electric current and being surrounded by a vitreous material forming a hermetic seal therewith and an intermediate metal coating covering the surface of the inlet conductor at least on the places to be welded. The essence of the invention is that the intermediate metal coating is made of rhenium, advantageously with a thickness from 3 to 1200 nm. As proposed, the intermediate rhenium layer should be produced by electrolytic deposition, especially from an aqueous solution.

The current inlet conductor as invented is very well weldable on the surfaces coated with rhenium, which also ensures good hermetic sealing with a vitreous material and is resistent to reducing environments, such as a hydrogen atmosphere during heat treatment, and can be prepared by a cheap and relatively simple method.

6 Claims, No Drawings

ELECTROLYTICALLY RHENIUM COATED MOLYBDENUM CURRENT INLET CONDUCTOR ASSEMBLY FOR VACUUM LAMPS

FIELD OF THE INVENTION

The invention relates to a current inlet conductor made of molybdenum covered by an intermediate metal coating at least on a part to be welded. The current inlet conductor according to the invention serves particularly in vacuum devices, e.g. in electric light sources for passing electric current through vitreous material, wherein the conductor can be tighted hermetically. The invention relates further to a method of producing the proposed current inlet conductor.

BACKGROUND OF THE INVENTION

The main requirements for current inlet conductors in the field of vacuum lamps are the following:

The current inlet conductor passed through a vitreous material closing device is generally to be connected to an element made of any metal in the innerspace of the device. The connection should be characterized by a defined level of mechanical and electrical features. In the case of electric light sources the electric inlet conductor is usually connected by welding, particularly by resistance welding to the metallic element. The principal requirement is consequently high weldability. Another requirement can be drafted as follows: the current inlet conductor should be capable of being surrounded and wetted by a vitreous material in order to produce a hermetic seal. The current inlet conductors of the vacuum devices are most generally made of molybdenum. In vacuum devices, for example, such as high-pressure gas discharge lamps or halogenide lamps comprising a bulb made of quartz glass, thin plates or foils made of molybdenum are used for supplying electric current to the electrodes. In the case of light sources with bulbs made of hard glass or in electronic tubes, molybdenum wires are generally used. In order to facilitate welding of the molybdenum parts and to improve the quality of binding to elements made of molybdenum, the molybdenum element characterized by low weldability is covered with an intermediate metal coating. Another possibility lies in applying between the surfaces to be connected to one another, an element made of intermediate metal of required characteristics. The material of the intermediate metal coating or element is chosen in order to ensure required mechanical features such as strength and toughness at higher temperatures of operation. These requirements especially in the case of halogenic lamps or lamps with metallic halogenic filling, are to resistance against the atmosphere surrounding the metallic element. According to the art the more widely used intermediate metals are tantalum and platinum, however, in the literature it is mentioned that the use of zirconium, rhodium, nickel, gold or palladium and the alloys thereof can be advantageous (e.g. W. Espe: "Material of High Vacuum Technology", Vol. 1., Ch. 9, Pergamon Press, 1966).

When applying a special intermediate point made of a required metal, it is obvious that a further element should be taken into account during production in that the metal has to be supplied at the place of operation and positioned according to the requirements. The process is thereby made more complex than without the coating step. It is an obvious simplifying step to cover the elements made of molybdenum with a coating of intermediate metal at least on the surface parts where welding is to be later applied. The coating should be prepared before applying the element for production of the light source. The French Patent Specification No. 2 079 541 proposes the previous covering of the molybdenum foil by lubricating the surface of the foil with a solution of a platinum alloy which can be fixed by following with heat treatment.

The published West German Patent Specification No. DE-OS 31 04 043 discloses a method of preparing the coating on the surface of a molybdenum foil by vacuum sputtering or evaporation of a suitable metal. This specification discloses also the use of platinum, and further of tantalum, gold and rhenium. These metals are mentioned as to be theoretically suitable for preparing a coating. The vacuum sputtered or evaporated coating has a thickness in range from 20 to 10,000 nm.

There are no more patent publications known of by the Applicant wherein the use of rhenium as a material for intermediate metal elements or coating is disclosed.

The main requirements for the intermediate metal are the facilitating of the welding and making possible a vacuum-tight seal in the vitreous material applied in the vacuum device in which a molybdenum element as a current inlet wire is provided. Taking into account the fact that for practicing the technology it is required to make a coating along the whole surface of the element made of molybdenum in a continuous method, it is obvious that the coating is prepared as a continuous layer. Therein lies a further requirement in that the coating should be made of a material which can be moistened or wetted by the vitreous material when it is in a melt or plastic state, because if it cannot be moistened, a reliable vacuum-tight binding is impossible between the glass and the intermediate metal coating. The noble metals, i.e. gold and platinum are not suitable for satisfying the mentioned requirements and as the Applicant experienced, the current inlet made of molybdenum and covered with a noble metal can not be vacuum sealed, by the glass, during operation the vacuum device losses the vacuum tightness of the closing. The same can appear during storage. The requirement of moistening can be satisfied by tantalum, however it is disadvantageous in that the element with a coating made of tantalum cannot be treated further in a protecting atmosphere comprising hydrogen and if it is done, the current inlet wire with tantalum coating is rendered unsuitable for further use. Such heat treatment, however, could be advantageous for reaching at least two aims:

1. The heat treatment is capable of strengthening the binding between the basic molybdenum part and the intermediate metal coating by means of diffusion.

2. By heat treatment it is possible to improve the surface layer of the current inlet wire according to the requirements of a glass-metal interface. From experience it is well known that the molybdenum foil applied to flat parts of a quartz glass vessel should be built in immediately or quickly after heat treatment because after some days of storage in air, the reliability of the junction realised thereby falls in an expressive manner. When welding is carried out in unsufficient circumstances, it can occur that the metal surface is subjected to oxidation and a unit comprising the current inlet wire and the objects welded to it should be annealed once more in hydrogen comprising environment i.e. in a reducing atmosphere.

OBJECT OF THE INVENTION

The object of the present invention is to provide a current inlet wire, on which an intermediate metal coating can be applied in order to ensure high weldability and hermetic sealing with the vitrous material used around the current inlet wire. the intermediate metal layer should well stand the heat treatment carried out in hydrogen, or other reducing atmosphere, and be preparable by a simple and quick method, for example by electrolytic deposition.

The invention is based on the recognition that a layer of rhenium coating the surface of molybdenum gives important advantages in comparison to other metals, which advantages have been not recognized so far in the art.

SUMMARY OF THE INVENTION

According to the invention, the object is achieved by a current inlet conductor for use particularly in vacuum devices, e.g. in electric light sources, wherein the current inlet conductor serves to pass electric current through a vitreous material and can be hermetically sealed in this material, the basic metal of the current inlet conductor being molybdenum, the whole surface of which or the surface part which is to be welded, is covered with an intermediate metal coating, the improvement of which lies in the fact that the intermediate metal coating is made of rhenium.

It has been found that for reaching the object, the thickness of the rhenium coating is not important and be a merely observable layer, a thickness of some nanometers range surprisingly providing a very good improvement in the weldability of the molybdenum with every vitreous material wetting and sticking to it in a very good manner. This also includes quartz glass, causing the most problems in the technologies of the art. Therefore it is advantageous to prepare a rhenium coating with a thickness in a range from 3 to 1000 nm and especially in a range from 10 to 100 nm.

A lot of methods are known for applying a rhenium coating, and as experience shows, in order to apply it on a molybdenum base, it is the most advantageous and simple to use electrolytic deposition, and advantageously from an aqueous solution.

Electrolytic deposition of rhenium from an aqueous solution can be carried out according to a lot of known methods. The oldest and as experience shows the simplest thereof is the method of deposition carried out from an aqueous solution of potassium perrhenate acidified by sulphuric acid. During production, the molybdenum basis metal should generally undergo treatments of electrochemical character, for example in order to prepare a very narrow edge of the foil, or to remove a graphite layer used on the wires for smearing, therefore a continuous process of preparing a rhenium intermediate coating can be very simply taken into account in a technology of producing a molybdenum element. The electrolytic deposition is an inexpensive operation requiring low investments and characterized by low level of material losses, oppositely for example to vacuum evaporation.

It is to be mentioned that the electrolytic deposition of tantalum from an aqueous solution has not been elaborated as far, oppositely to the rhenium.

The required features of the molybdenum elements can be ensured by a very thin rhenium coating wherein the thickness is not very important, however, it can be ensured with good accuracy by means of electrolytic deposition.

If a molybdenum foil is used a rhenium coating should be applied only on the surface to be welded, the surface opposite to that to be coated by rhenium should be provided on isolating holder elements, advantageously on a cylinder made of an insulating material.

The invention will be described further, purely by way of example, by a method for preparing a rhenium coating on a molybdenum foil which is to be used as a basic metal element of a current inlet conductor in a quartz body of a mercury discharge lamp. The foil is 2.5 mm wide and 25 μm thick; the edges thereof are prepared in the form of a knife-edge by means of electrolytic pickling. The foil after leaving the pickling device is fed by a device comprising metal rollers and thereafter a rolling cylinder made of insulating material or coated by insulating material, e.g. rubber and having a diameter of 100 mm. This cylinder is immersed in a electrolyte a depth of about 35 mm, wherein the electrolyte comprises in each liter of water 10 g $KReO_4$ and 4 g concentrated $H_2SO_4$. The counter electrode consists of platinum and is connected to the positive pole of a current source, the negative pole of which is connected to the metal roller providing the foil before immersing it into the electrolyte. The foil should be fed into the device with a speed ensuring about 30 sec residence time for every point of the foil to be immersed in the electrolyte. The deposition should be carried out at room temperature, applying a current density of about 800 $A/m^2$ range. The foil leaving the electrolytic bath is rinsed in counterflowing water, and therafter dried in a stream of air. The process should be terminated by heating the foil in an atmosphere of hydrogen having a temperature as high as 1100° C.

The device as described ensures coating the foil with rhenium on only one side, however this is fully satisfactory if welding is to be applied later only to that side of the foil. When the foil is to be welded on both sides or a wire is to be coated by rhenium it can be made by means of the method described above without difficulty. The circumstances of the electrolytic deposition can be adjusted in a wide value. Of course, if it is desired, a lot of baths with different compositions can be used.

Instead of electrolytic deposition, other methods can also be used. Among them the vacuum deposition, vacuum sputtering, or chemical vapor phase deposition (CDV) should be mentioned, however, these methods are more expensive and are characterized by higher material losses than the electrolytic deposition.

The advantages of the current inlet conductor as invented can be summerized as follows: the surface coated by rhenium is very well weldable, ensures hermetic sealing with vitreous material, is resistent to a reducing environment and thereby to a hydrogen atmosphere during heat treatment, and can be prepared by a cheap and relatively simple method.

The field of protection defined by the claims is not of course restricted to the preferred embodiments described above, which are purely by way of example. The invention is applicable to producing any vacuum device comprising molybdenum current inlet conductors.

We claim:

1. A current inlet conductor assembly, particularly for vacuum devices, especially for light sources such as incandescent lamps or discharge tubes, consisting of an inlet conductor made of molybdenum for passing electric current and being surrounded by a vitreous silica material forming a hermetic seal therewith and an intermediate electrolytically deposited rhenium coating of a thickness of 3 to 1000 nm covering the surface of said molybdenum at least on the portions to be welded and wetted by the vitreous silica material.

2. The assembly defined in claim 1, wherein said inlet conductor is covered by a rhenium coating of 10 to 100 nm range thickness.

3. A method of making a current inlet conductor assembly comprising the steps of providing a molybdenum body inlet conductor for passing electric current through a vitreous material, immersing the molybdenum body of said inlet conductor in an electrolyte comprising an electrolytically depositable compound of rhenium, depositing rhenium from the electrolyte on the inlet conductor by means of an electric current in a thickness of 3 to 1000 nm, mounting the rhenium-coated body in vitreous silica which wets the rhenium coating, and welding to said rhenium coating another metal.

4. The method defined in claim 3, wherein the body of said inlet conductor is immersed in an aqueous electrolyte comprising a perrhenate salt rhenium soluble in water.

5. The method defined in claim 3, wherein the inlet conductor is immersed in the electrolyte with only the surface to be welded exposed thereto, the other surfaces of said inlet conductor being covered by an insulating material.

6. A method of making a current inlet conductor assembly for vacuum lamps comprising the steps of:

electrolytically coating with rhenium at least a portion of a molybdenum inlet conductor;

welding a resistance element to said portion; and surrounding and wetting said portion of said inlet conductor with a vitreous silica material thereby forming a hermetic seal therewith.

* * * * *